US008235259B2

(12) United States Patent
Johnson et al.

(10) Patent No.: US 8,235,259 B2
(45) Date of Patent: Aug. 7, 2012

(54) INTEGRATED FITMENT FOR ASEPTIC PACKAGING

(75) Inventors: James Johnson, Delaware, OH (US); Thomas Svensson, Marple (GB); Stewart M. Graves, Powell, OH (US)

(73) Assignee: Liqui-Box Corporation, Worthington, OH (US)

( * ) Notice: Subject to any disclaimer, the term of this patent is extended or adjusted under 35 U.S.C. 154(b) by 0 days.

(21) Appl. No.: 12/854,615

(22) Filed: Aug. 11, 2010

(65) Prior Publication Data

US 2011/0036865 A1 Feb. 17, 2011

Related U.S. Application Data

(62) Division of application No. 11/346,663, filed on Feb. 3, 2006, now Pat. No. 7,798,379.

(60) Provisional application No. 60/650,005, filed on Feb. 3, 2005.

(51) Int. Cl.
*B65D 47/00* (2006.01)

(52) U.S. Cl. ..... 222/563; 383/36; 53/469

(58) Field of Classification Search ..... 222/563, 222/566–572; 383/66, 96, 41; 53/469, 468; 215/364

See application file for complete search history.

(56) References Cited

U.S. PATENT DOCUMENTS

| | | | | |
|---|---|---|---|---|
| 2,171,730 | A * | 9/1939 | Lobl | 383/66 |
| 2,413,721 | A | 1/1947 | Lobl | |
| 2,499,150 | A | 2/1950 | Lobl | |
| 2,571,144 | A | 10/1951 | Lobl | |
| 3,215,319 | A * | 11/1965 | Laker | 222/213 |
| 4,731,978 | A | 3/1988 | Martensson | |
| 5,551,590 | A * | 9/1996 | Mazur et al. | 220/23.83 |
| 5,779,894 | A | 7/1998 | Martensson | |
| 6,039,182 | A | 3/2000 | Light | |
| 6,357,090 | B1 * | 3/2002 | Murai | 24/593.1 |

FOREIGN PATENT DOCUMENTS

WO WO96/03319 2/1996

OTHER PUBLICATIONS

Notification of Transmittal of the International Search Report and Written Opinion for corresponding PCT application No. PCT/CA2006/000153.

* cited by examiner

*Primary Examiner* — Lien Ngo
(74) *Attorney, Agent, or Firm* — Potter Anderson Corroon LLP; Rakesh H. Mehta, Esq.

(57) ABSTRACT

The present invention provides a fitment, for use on a flexible container, comprising a spout member having a first end and a second end and defining a passageway between the two and a plug member which is sized to be received in the passageway. The plug member also has a leading end that lies in sealing engagement with the first end of the spout member when the plug member is received in the passageway.

2 Claims, 9 Drawing Sheets

INTEGRATED FITMENT FOR ASEPTIC PACKAGING

CROSS-REFERENCE TO RELATED APPLICATION

This application is a Divisional Patent Application claiming priority under 35 U.S.C. §121 from U.S. patent application Ser. No. 11/346,663, filed on Feb. 6, 2006, which claims priority to Provisional Application Ser. No. 60/650,005, filed on Feb. 3, 2005. The entire contents of these applications are hereby incorporated by reference.

FIELD OF THE INVENTION

The present invention is related to an integrated fitment for use in an aseptic flexible walled container for liquid packaging which is used to receive product under aseptic conditions.

BACKGROUND OF THE INVENTION

Flexible walled containers of various sizes are often used to store and/or transport liquid food under sterilized conditions. A container of this type often consists of at least a pair of multi-ply structured walls, and a spout for receiving and dispensing food products. The spout is generally applied on one side of one of the walls by means of heat-sealing and can be closed by a plug or cap. The plug or cap for the spout can be either a separate part applied from the top of the spout, or be an integral part of the bag heat-sealed to the opposing wall from the spout. The latter has shown many advantages in aseptic filling including oxygen prevention, sterilization and bag management.

Containers known in the art include those having both the spout and plug made of same material that is relatively stiff compared to the material for the container. To enforce a liquid tight seal, an O-ring is generally used between the plug and the spout. Prior to use for packaging, the containers are completely sterilized by gamma rays. Then the bags are transported to the food packaging manufacturer. Since during storage, transportation and preparation for filling, the outer surface of the bag and spout/plug may be exposed to the environment and lose sterility, the seal at the fitment is critical for keeping sterility inside the container.

At the filling station, before the food can be introduced into the bag, sterile conditions have to be restored for any part of the bag that could get into contact with the food during the filling process. For example with the filling method described in U.S. Pat. No. 4,731,978, the only parts that need to be re-sterilized for this type of bag are the rim of the spout, the top surface of the plug, and the crack between the plug and the spout before the seal is formed with the O-ring. To sterilize these parts, they are flushed with steam for a certain period of time. However, a uniform temperature at these places is not ensured in a short-term steam flush. At the crack before the O-ring, lower temperatures may occur, leading to a potential health safety problem. Therefore, a prolonged steam-flushing time is required for this design. In addition, a cap on top of the fitment is generally used to minimize the risk of contamination. The O-ring, in such a design, being a separate part of the plug may be displaced on the assembly line, or during the open and close procedures. Furthermore, these extra parts on the spout/plug make the fitment assembly time consuming and costly.

When the filling process is finished, the plug from inside of the bag closes the spout. Since the plug is pulled into the bag during the filling and the sleeve of the spout is part of the channel for food flow, both surfaces may be covered with food after filling. Although steam flush cleaning is generally used during the closing stage, complete cleanliness on both plug and spout surface may be difficult to achieve, particularly for food with high viscosity. In this case, food may be caught in the pockets formed around the O-ring and in the crack between the plug and the spout. Although these foods have no impact on the food inside the bag, they are exposed to the environment after filling and are a potential source of contamination. If the spout is to be used for dispensing, this part will be very difficult to be cleaned and sterilized again.

SUMMARY OF THE INVENTION

The present invention provides a fitment that allows for easy cleaning and sterilization and continued re-use.

The present invention provides a fitment, for use on a flexible container, comprising a spout member having a substantially cylindrical body with a first and second end and defining a passageway through the body. The second end having a flange portion extending from the end for attachment of the spout member to a flexible container. The fitment also has a plug member that is sized to be received in the passageway of the spout member, and has a leading end having a substantially planar top surface and a trailing end which is adapted to attach to a flexible container. The planar surface of the leading end has a peripheral edge that lies flush and in sealing engagement with the surface of the first end of the spout member when the plug member is received within the spout member.

The present invention further provides a fitment, for use on a flexible container, comprising a spout member having a first and second end and defining a passageway between the two. The second end has a first attachment means for attachment of the spout member to a flexible container. The fitment also has a plug member with a body portion and a second attachment means for attaching the plug member to the flexible container. The body portion is sized to be received within the passageway of the spout member and has an upper surface portion that lies adjacent and in sealing engagement with the first end of the spout member when the plug member is received within the passageway of the spout member.

The present invention further provides a fitment, for use on a flexible container, comprising a spout member having a first end and a second end and defining a passageway between the two and a plug member which is sized to be received in the passageway. The plug member also has a leading end that lies in sealing engagement with the first end of the spout member when the plug member is received in the passageway.

The present invention further provides a fitment, for use on a flexible container, comprising a spout member having a first end and a second end and defining a passageway between the two ends. The fitment also has a plug member with a body portion which is sized to be received within the passageway of the spout member. The body portion includes a leading edge portion. The plug member is movable between a first position in which the leading edge of the plug member lies flush with the first end of the spout member and a second position in which the leading end of the plug member extends beyond the first end of the spout member. The first position provides a first seal between the plug and spout members and the second position provides a second seal between the plug and spout members, the second seal being at a different location than the first seal.

The present invention farther provides for a flexible container having at least a pair of opposed flexible walls sealingly attached to each other and forming a container therebetween and attached to the bag a fitment of any of the embodiments described herein.

The fitment of the present invention provides an aseptic seal and allows for easy steam sterilization and cleaning of the flexible bags to which the fitment is attached.

BRIEF DESCRIPTION OF THE DRAWINGS

The present invention will be described in relation to the following non-limiting figures in which.

DETAILED DESCRIPTION OF THE EMBODIMENTS

Figure 1:
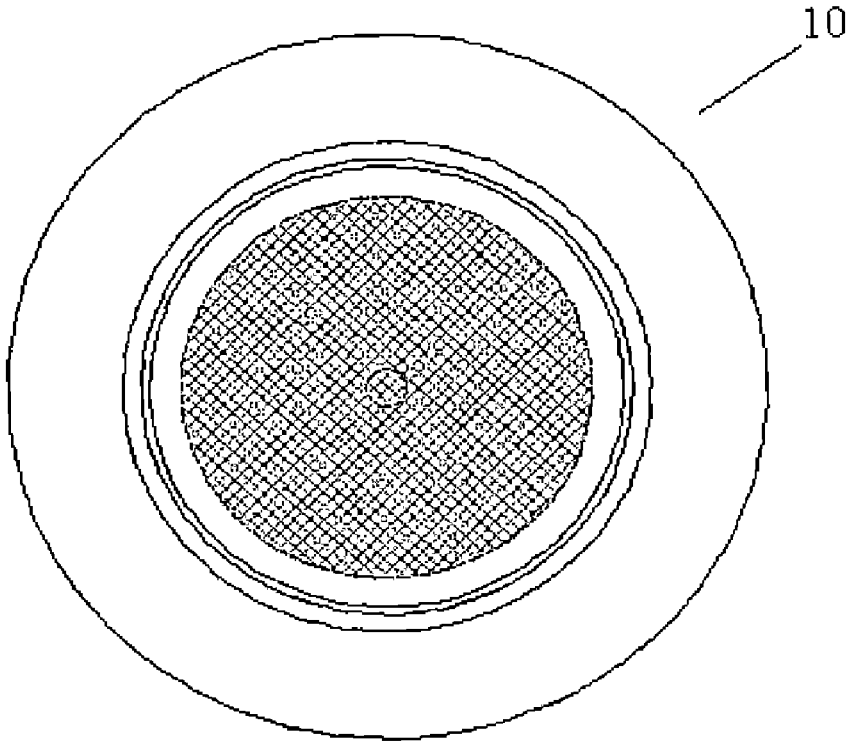
FIG. 1 is a top view of one embodiment of the integrated fitment of the present invention having a plug member received within a spout member.
Figure 2:
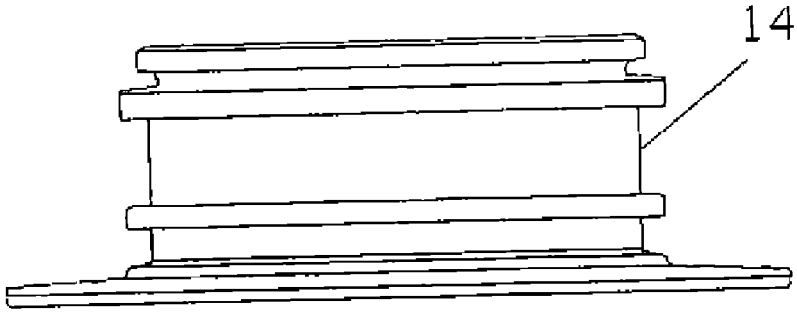
FIG. 2 is a side view of the integrated fitment of FIG. 1 showing the exterior of the spout member of the fitment.
Figure 3:
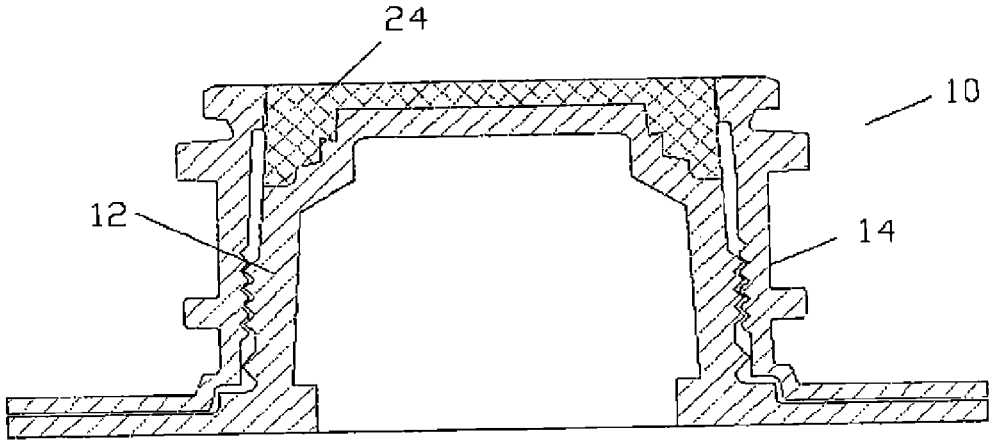
FIG. 3 is a cross-sectional side view of the fitment of FIG. 1 showing the spout member with the plug member being fully received within the spout member.
Figure 4:
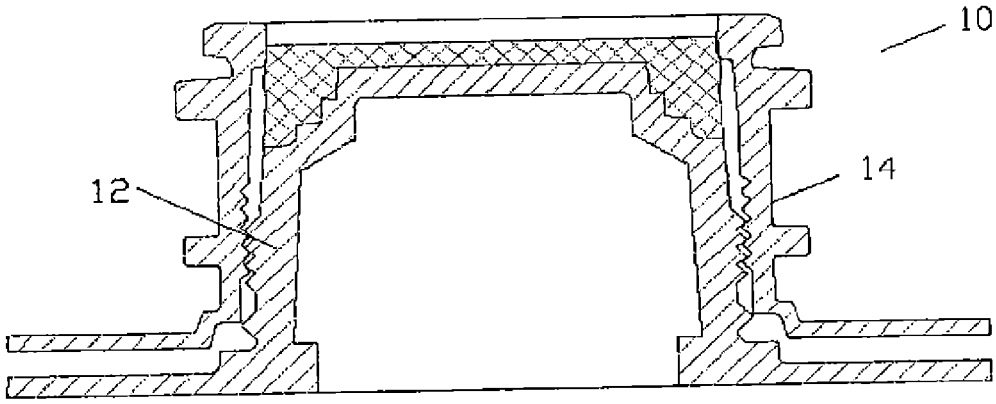
FIG. 4 is a cross-sectional side view of the integrated fitment of FIG. 3 with the plug member partially received within the spout member.

The present invention provides a fitment, for use on a flexible container. The fitment, which will be described in detail below, with reference to the drawings, comprises a spout member defining a passageway therein and a plug member that is sized to be received within the passageway. When the plug of the present invention is received in the passageway of the spout member a seal is created at one end that can be repeatedly broken and re-sealed and that provides for easy sterilization.

The fitment of the present invention will now be described with reference to FIGS. 1 through 14.

First, turning to FIGS. 1 through 6, one embodiment of the fitment will be described. As can be seen clearly in FIGS. 1 through 6, and in particular in FIG. 6, the fitment 10 comprises a plug member 12 and a spout member 14.

Figure 5:
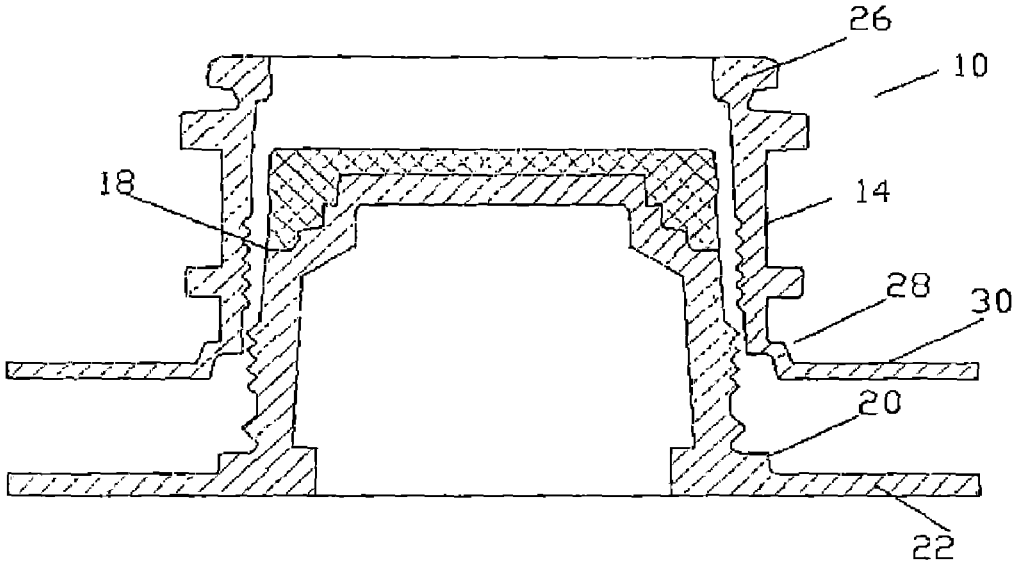
FIG. 5 is a cross-sectional side view of the integrated fitment of FIG. 3 with the plug member beginning to be received within the spout member.

The plug member 12 has a body portion 13, identified in FIG. 5, that includes a leading end 18 and a trailing end 20. The trailing end 20 includes a first flange 22 extending therefrom for attachment of the plug member 12 to a surface of a container, not shown in FIGS. 1 through 6 but described in more detail below. The leading end 18 further includes a top (or upper) surface portion 24. The body portion 13 of the plug member 12 is sized to be received within the spout member 14, and more particularly within a passageway 16 defined within and through the spout member 14.

Figure 6:
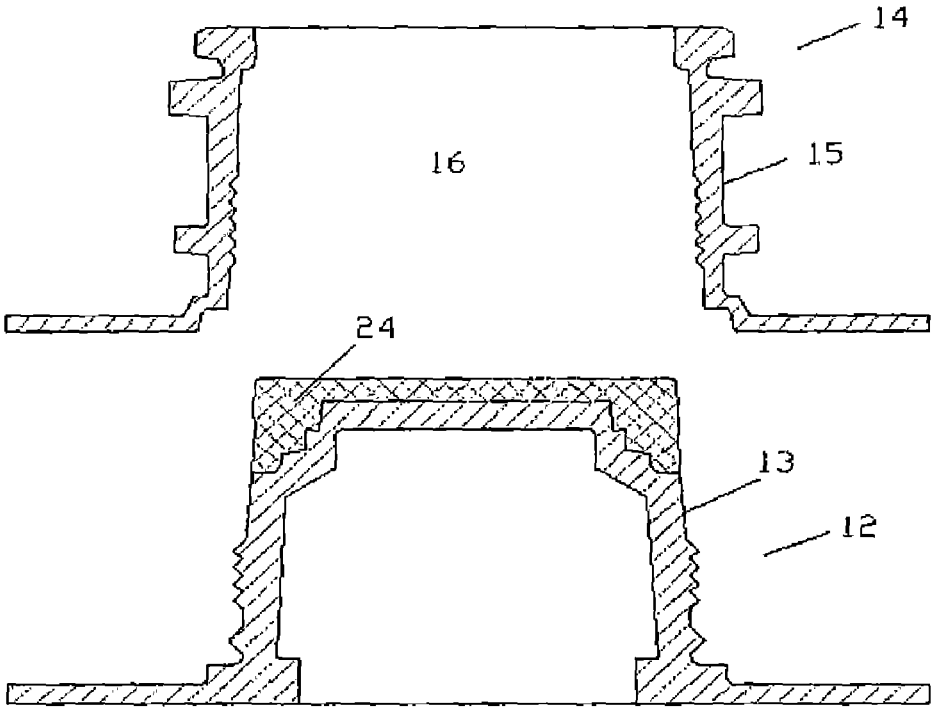
FIG. 6 is a cross-sectional side view of the integrated fitment of FIG. 3 with the plug member separated from the spout member.

As described above, the spout member 14 has a body 15, identified FIG. 6, that defines a passageway 16 therethrough that is sized to receive the plug member 12 and that allows for the passage of fluid therethrough when the plug member 12 is not received within the passageway 16. The spout member has a first end 26 and a second end 28 to which is attached a second flange 30 for attachment of the spout member to a surface of a container (discussed in further detail below).

In use the fitment 10 is attached to a container that is operable to receive fluid product, preferably the container is operable to be used to receive and store fluids under aseptic conditions.

In one embodiment the spout member has a substantially cylindrical body 15. It will be understood by a person skilled in the art that the body 15 may be other than cylindrical in shape. For example the body portion may be substantially cone shaped. The important feature of the shape of the spout and plug member is that the plug member is sized and shaped to be received within the passageway of the spout member, and is able to provide a sealing engagement at the exterior connection of the two pieces, i.e. the external edge of the surface portion of the plug member and the top end of the spout member, without impacting the flow of fluid through the spout member when required.

As also stated above, the plug member 12 is sized to be received in the passageway 16 of the spout member 14. In one embodiment, the plug member 12 has a leading end 18 having a substantially planar top surface portion 24 and a trailing end 20 adapted to attach to a flexible container by way of a second flange 22.

In one embodiment the plug member 12 is sized so that when it is received within the passageway of the spout member 14 the leading end 18 extends into the passageway 16 and the top surface portion 24 lies adjacent and flush with the first end 26 of the spout member 14.

In one embodiment the top surface portion 24 is planar. The planar surface 24 of the leading end 18 may also include a peripheral edge portion 30 that lies flush and in sealing engagement with the first end 26 of the spout member 14 when the plug member 12 is received therein. In the embodiment illustrated the spout member 14 has a substantially cylindrical body 15 with a passageway 16 therethrough, and therefore the plug member 12 is also shaped to be substantially cylindrical so that it may be received within the passageway 16. In this embodiment the peripheral edge portion 30 (not illustrated) may be located around the circumference of the surface portion 24 of the plug member 12.

The fitment 10, including the spout member 14 and plug member 12, may be made from material of relatively high stiffness, for example high or medium density polyethylene, nylon and polyester. The spout member 14 and plug member 12 may each be integrally formed by injection molding.

To form a liquid proof and aseptically safe seal between the plug member 12 and the spout member 14, two different types of material may be used for either one of the two parts.

Alternatively the plug member 12 may include a surface portion 24 at the leading end 18 made from a different material than the rest of the plug member 12 and the spout member 14. Alternatively a portion of the surface portion 24 may be made of a different material such as a peripheral edge portion 30. If two different materials are used they will have different mechanical properties and can be molecularly integrally bonded. For example if the surface portion 24 of the plug member 12 is made from a different material, in the sequential molding process, the core part of the plug 12 is formed first. Then relatively soft material is molded onto the top/surface part of the plug. The different hardness on the spout and plug surface provides a wide range of freedom for the seal design. The seal can be formed right at the rim of the spout, and sequential seals can be present along the axis of the fitment. Examples of the combinations of materials that may be used include, but are not limited to high density polyethylene/Santoprene, high density polyethylene/Elastotec, medium density polyethylene/Santoprene, medium density polyethylene/Elastotec. Methods of forming the plug member from more than one material are known to a person skilled in the art and may include, but are not limited to, co-injecting molding.

Figure 8:
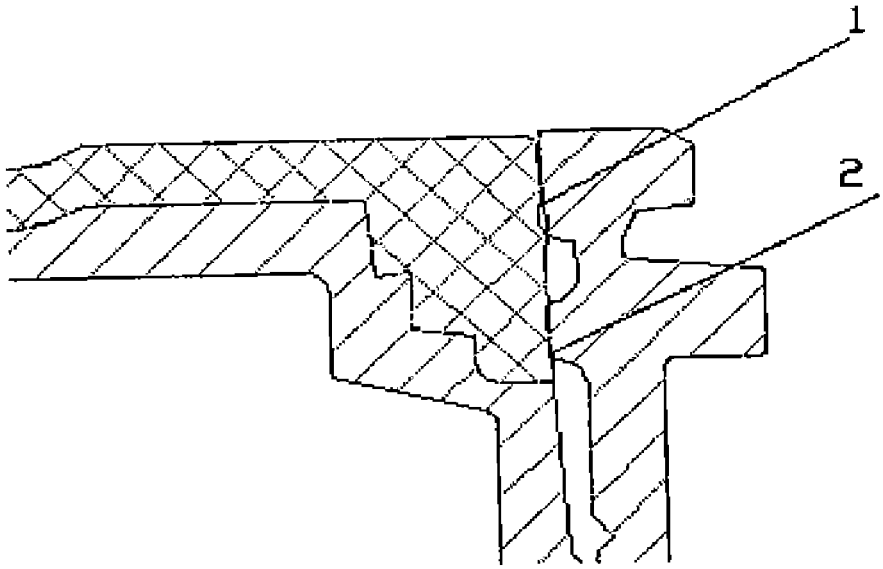
FIG. 8 shows a magnified view of portion A of FIG. 7.

As stated above, to form a liquid proof and aseptic safe seal between the plug member 12 and the spout member 14, two different types of material with different mechanical properties may be used for either one of the two parts that typically form the fitment 10 and/or the plug member 12. Sequences of seals may be formed along the axis direction of the fitment 10, the first seal being at the rim of the spout member 14, as illustrated in FIG. 8 at positions 1 and 2. The different materials used in the fitment 10 allow for the opening and reclosing of the bag without damage to the seal. These features provide a safe and simple flexible container for aseptic packaging.

The present invention provides for a flush sealing engagement between the plug member 12 and the spout member 14. More particularly the invention provides for a flush sealing engagement between the surface 24 of the plug member 12 and the spout member 14. More particularly the invention provides for flush sealing engagement between the peripheral edge 30 of the surface portion 24 of the plug member 12 and the first end 26 of the spout member 14. This allows for efficient sterilization prior to filling of the container and prevents any cracks from forming between the spout member 14 and the plug member 12.

The present invention also provides for a two piece fitment 10 comprising a plug member 12 and a spout member 14. The present invention does not necessitate the requirement of an extra part, such as an O-ring, between the plug member 12 and spout member 14 thereby providing for sealing engagement between spout member 14 and the plug member 12 at a fixed location.

The present invention also provides for a fully integrated fitment 10. Further the fitment 10 of the present invention also allows for a relatively short spout member 14 and plug member 12 which may reduce the required material necessary for the manufacture of the fitment 10 and therefore manufacturing time and storage space can be reduced.

The present invention further provides a plug member 12 having a substantially planar surface portion 24 which allows for easy cleaning and sterilization.

When at least a portion of the surface 24 of the plug member 12 is made from a material that differs from that of the spout member 14, the seal is formed between two materials with different hardness, one of them an elastic material such as natural and synthetic rubber (elastomer), for example: Santoprene, Elastotec, Dryflex and Viton. Elastomers and natural rubber are amorphous long-chain polymers which are capable of cross-linking. By adding various ingredients, different elastomer compounds can be created. Elastomer and natural rubber can restore energy as response to an applied energy, but some energy dissipation is always happening due to their viscoelastic nature. After the deformation force is removed, elastomer and natural rubber can resume its original shape. The International Rubber Harness Degree (IRHD) scale has a range of 0 to 100 corresponding to elastic modulus. The working temperature could be from −65° C. to 265° C. The seal can be ensured after several times of opening and closing because of the elastic properties of the material. Therefore, the bag can be safely opened and re-closed for the partial discharge of its content. Generally material previously used cannot regain their original shape after the deformation force is removed and therefore cannot ensure a tight seal after use. In previous designs an additional piece of material, generally an O-ring, is usually used between the spout and plug to ensure a seal between the two parts.

In addition, the second material, which may continuously cover the surface 24 of the plug member 12, preferably has a higher melting point than the material for the remainder of the plug member 12, and therefore relative high sterilization temperatures may be used and there is less chance for heat damage on the plug. The second material continuously covering the upper part of the plug also provides a continuous surface above the sealing area. The critical sealing area is therefore minimized to being only between two parts, those being the plug member 12 and the spout member 14. In designs previously used, both the seal between the O-ring and the plug member, and the seal between the O-ring and the spout member are critical.

Figure 7:
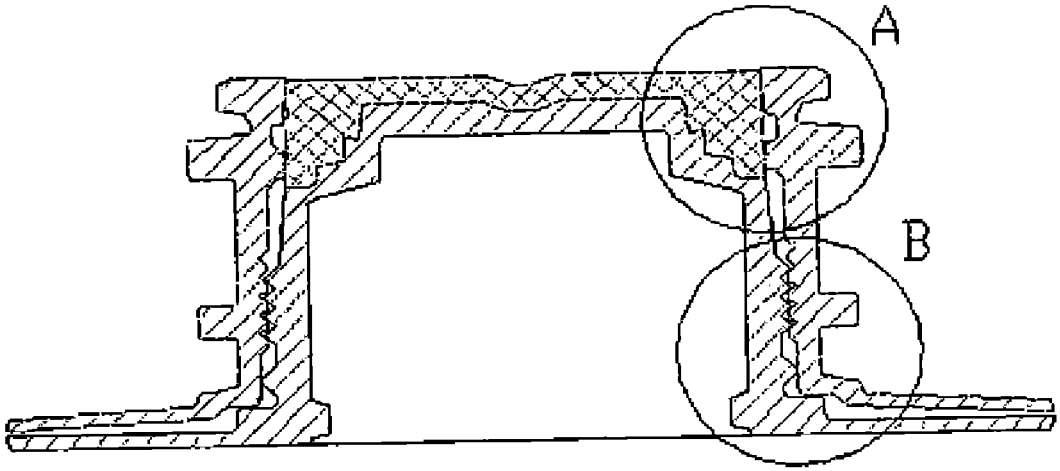
FIG. 7 shows a cross-sectional side view of an alternate embodiment of the fitment of FIG. 3.

It will be understood by a person skilled in the art that the surface portion 24 of the plug member 12 is not required to be a planar smooth surface. For example, and as illustrated in FIG. 7, the surface portion may include an indentation. Such an indentation may be formed during the injection molding process that forms the plug member 12. Alternatively, the surface portion 24 may include other indentations thereon and variations may be made by a person skilled in the art that do not interfere with the sealing engagement of the plug and spout members. Other embodiments may include other non-planar surfaces, for example having more than one indentation on the surface portion.

Figure 9:
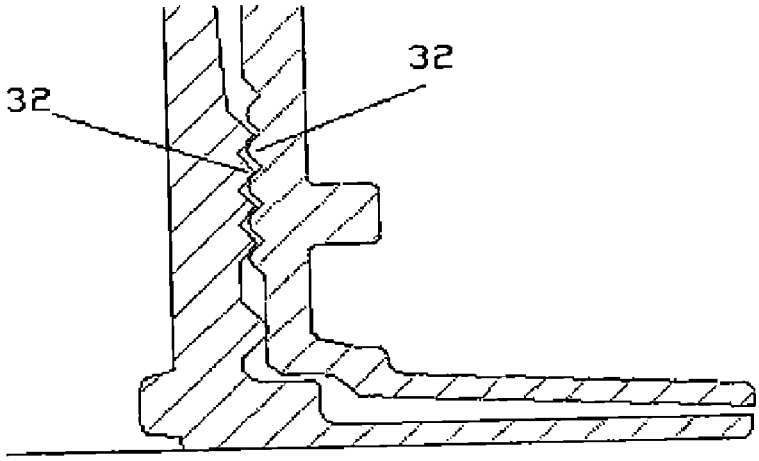
FIG. 9 shows a magnified view of portion B of FIG. 7.

As can be seen clearly in FIG. 9, the plug member 12 and the spout member 14 may also comprise mating attachment means, such as a series of interlocking teeth, to provide additional connection means. In such an embodiment the plug member 12 will include a series of attachment means, shown as teeth 32, on the external surface adjacent the trailing end 20 and the spout member 14 will include a series of corresponding mating attachment means, also shown as teeth 32, on an internal surface adjacent the second end 28. The attachment means (teeth 32) are located at positions that will allow for mating attachment when the plug member 12 is located within the passageway 16 of the spout member 14. This provides additional engagement means for securing the plug member 12 within the spout member 14.

The fitment 10 of the present invention will now be described in use on a container 34 with reference to FIGS. 10 and 11, including a discussion of the filling operation. The flexible container 34 includes the fitment 10 with the spout member 14 and plug member 12. As mentioned above, the container 34 is made from a pair of multi-ply structured walls 36, 38 of flexible material.

In one embodiment the flexible container to which the fitment is attached comprises a pair of multi-ply structured walls with oxygen/moisture barrier layers to enclose a volume that contains liquid foodstuff. To engage the fitment 10, a hole (not shown) is cut through one side of one wall of the container. The body 15 of the spout member 14 of the fitment 10, with the plug member 12 located within the passageway 16 of the spout member 14, is then pushed through the hole from the inside of the container. Methods of pulling and/or pushing the plug member within the spout are known in the art. For example, U.S. Pat. No. 4,731,978 describes a machine for aseptic filling of containers including a spout and plug member. The outward directed flanges 22, 30 from both the plug member 12 and the spout member 14 remain inside the container 34. A sealing device then fastens the flanges 22, 30 of the spout member 14 and the plug member 12 with an annular seal independently to the inner surface of each opposing wall 36, 38 inside the container 34. Sealing the plug member 12 and spout member 14 to the bag walls 36,38 in an assembled state in the same process ensures the alignment of the sleeve axis for both parts.

Figure 10:
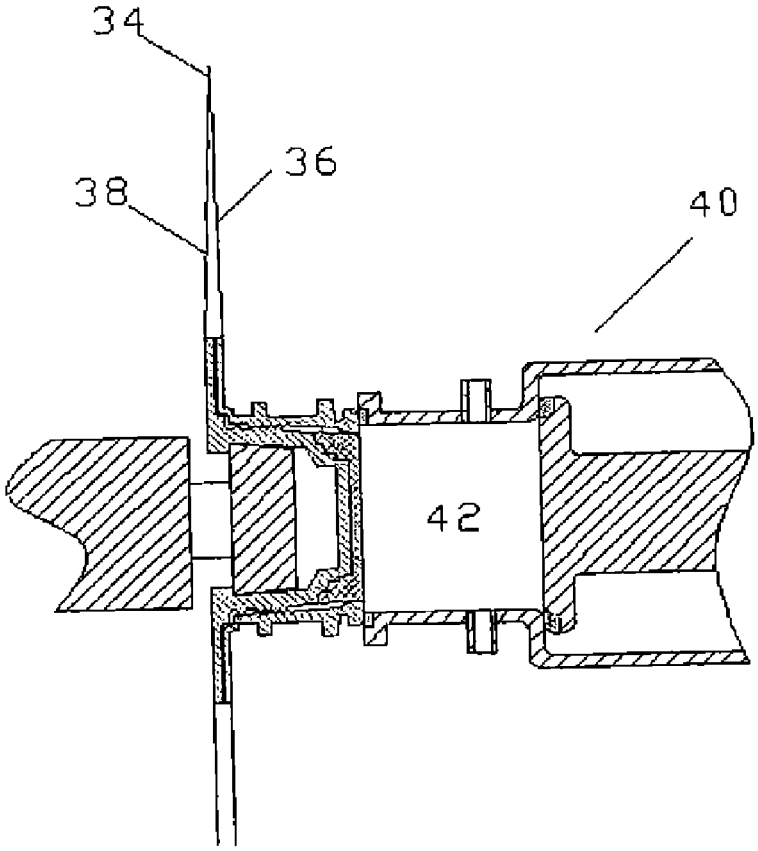
FIG. 10 shows a cross-sectional side view of an integrated fitment according to FIG. 3 attached to a flexible container in a closed pre-filling position attached to a filling apparatus.
Figure 11:
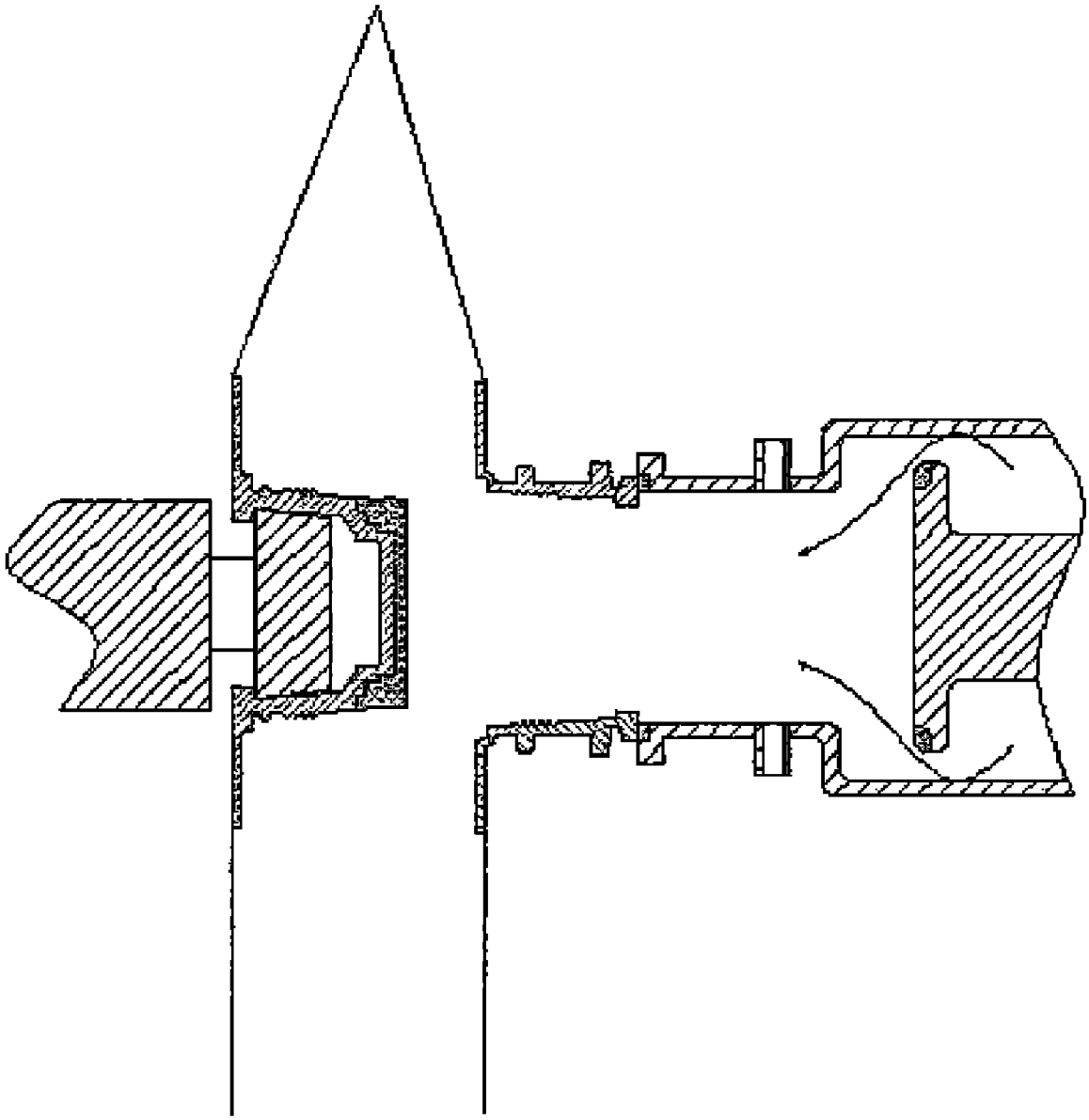
FIG. 11 shows a cross-sectional side view of the fitment of FIG. 3 attached to the flexible container, as shown in FIG. 10, with the fitment in an open position and the filling apparatus in a filling position.

FIGS. 10 and 11 illustrate the filling method using one embodiment of the fitment of the present invention. It will be understood that the filling procedure will be the same for other embodiments that have also been discussed herein. To fill the flexible container 10, the spout member 14 and the plug member 12 are both brought into engagement with the operating equipment 40, which holds the spout member 14 tight against the filling opening and moves the plug member 12 to open and close the container. Before the filling process, high-pressure steam is introduced into the chamber 42 formed by the fitment and the filling opening. After the steam sterilization on the surface 24 of the leading end 18 of the plug member 12 and the filling opening, the plug member 12 is pulled into the container and at the same time the filling valve opens as illustrated in FIG. 11. The filling material is forced into the container 34 under the pressure of the supply line. When the filling process is finished, the filling valve closes the supply line, and the filling paths are cleaned by steam flush. Thereafter, the plug member 12 is pushed from the inside of the container into the passageway 16 of the spout member 14 to close the fitment 10 and provide an aseptic seal.

Figure 12:
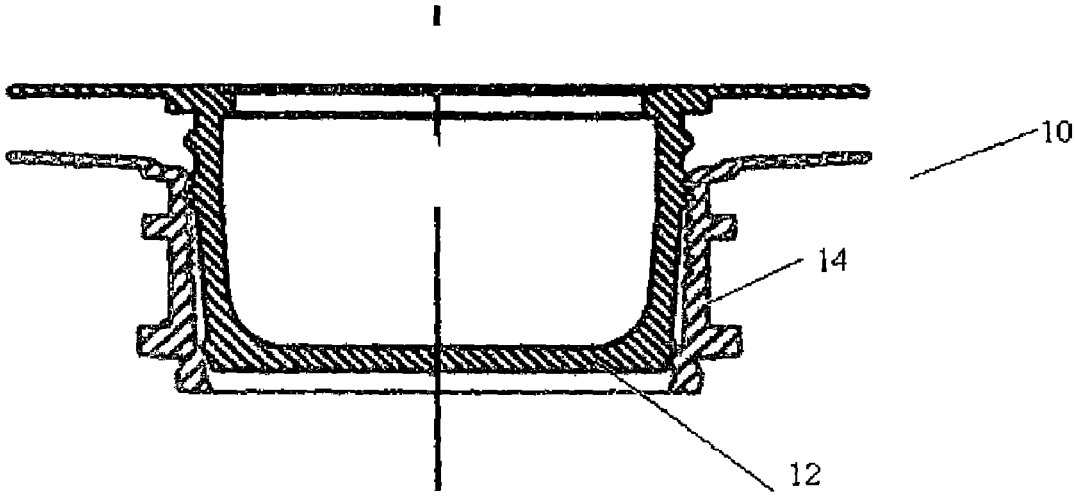
FIG. 12 shows a cross-sectional view of a further alternate embodiment of the integrated fitment of the present invention in the pre cap position.
Figure 13A:
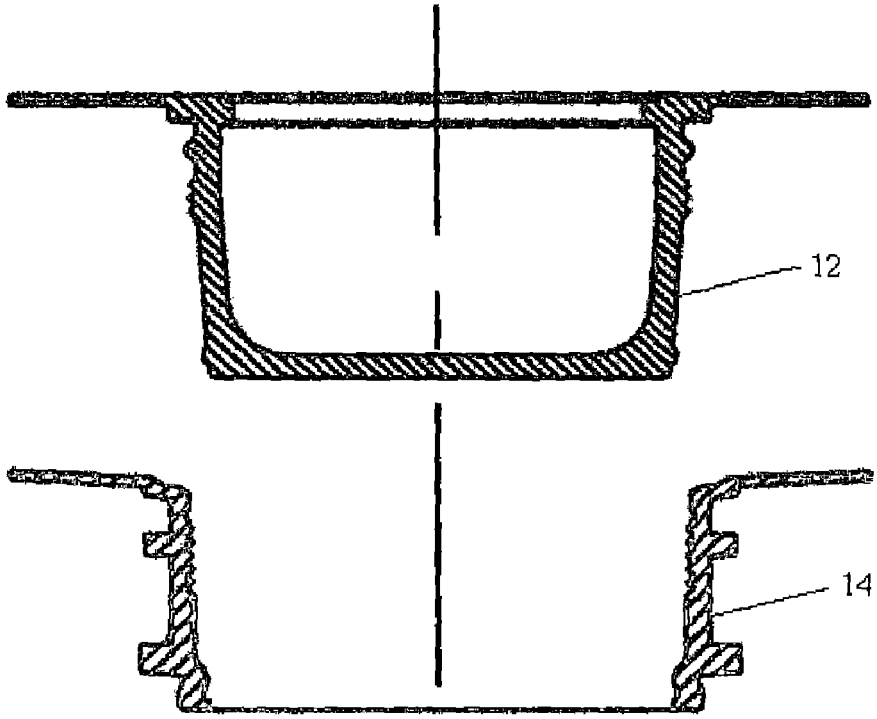
FIGS. 13A and B show a series of cross-sectional views of the fitment of FIG. 12 as the plug member is inserted into the spout member.
Figure 13B:
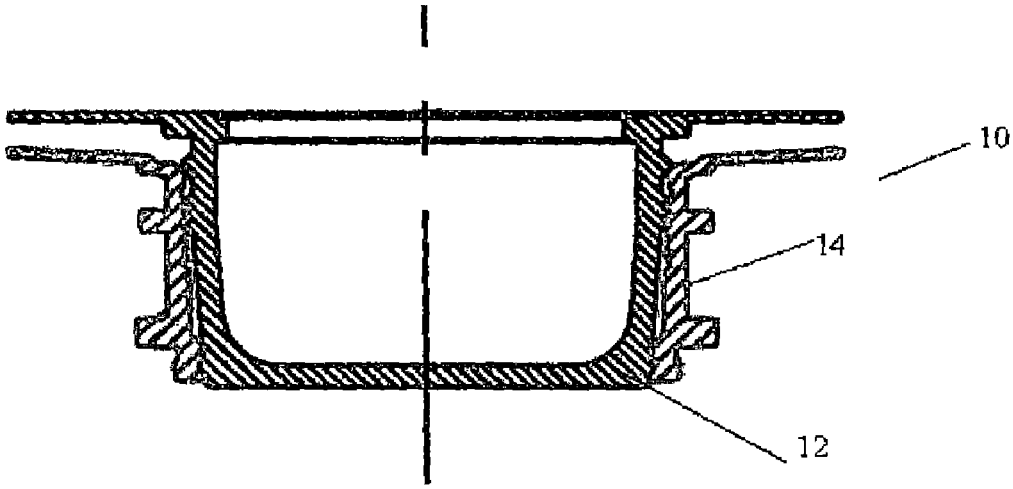
Figure 14:
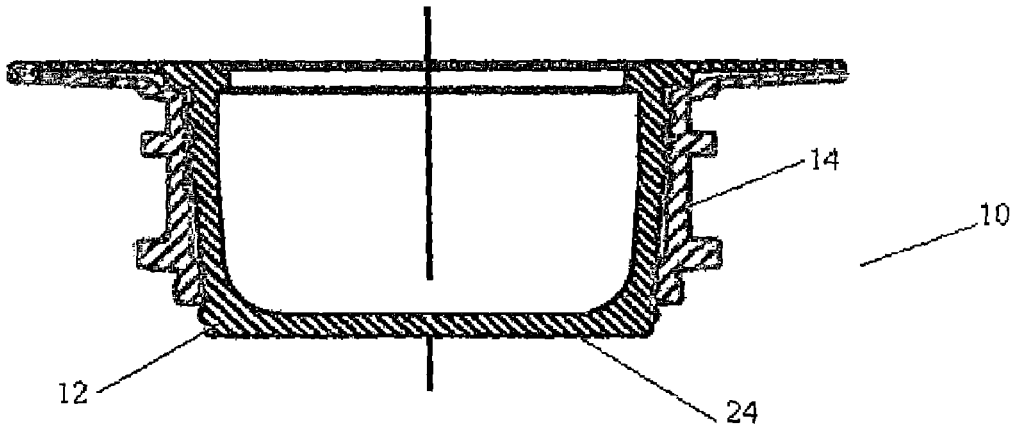
FIG. 14 shows a cross-sectional view of the fitment of FIG. 12 in the full cap position.

In an alternative embodiment of the present invention, as illustrated in FIGS. 12 through 14, the fitment 10 has a spout member 14 and a plug member 12 that is received within a passageway 16 in the spout member 14 and is operable within the spout member 14 between a pre cap position shown in FIG. 12 and a full cap position shown in FIG. 14.

In the pre cap position the leading, edge 18 of the plug member 12 lies flush with the first end 26 of the spout member 14, creating a seal between the plug member 12 and the spout member 14 as discussed above. In the full cap position the leading end 18 of the plug member 12 extends beyond the first end 26 of the spout member 14, creating a seal between the first end 26 of the spout member 14 and the exterior peripheral surface of the plug member 12 that lies adjacent the first end 26, indicated generally at numeral C in FIG. 14. It will be understood that additional seals may also be created along the axis of the plug member 12 with the interior surface of the spout member 14, as discussed above in the alternate embodiment.

The pre cap position is used prior to aseptic filling of the container. Once the container has been aseptically filled the plug member 12 is received within the spout member 14 and is placed in the full cap position, illustrated in FIG. 14, by the filling apparatus. In this embodiment the plug member 12 is sized to be fully received within the passageway 16 of the spout member 14 and to extend beyond the spout member 14 when in the full, cap position. In this embodiment, the plug member 12 and the spout member 14 are preferably made from the same material. The positioning of the fitment between two separate sealing positions, i.e. the pre-cap and the full cap, allows for the fitment to be made from one material since the seal is not reformed at the same place in the second position.

With the current invention, the seal between the spout member 14 and the plug member 12 can also be formed by a small transition change of diameter of the spout member at the first end. The advantage of this design is the smooth inner surface at the end portion of the spout member 14. This surface can be easily cleaned by steam flush after filling. If any food residues exist, the plug will easily push them out. Since the diameter of the spout member is gradually reduced toward the top end, the first seal is guaranteed at the top of the sleeve.

Example 1

Sterilization Temperature Test

Steam sterilization is a typical method used to restore sterile condition of the fitment with the filling method described above. During this process, high-pressure steam is introduced into a chamber partly formed by the top surface of the fitment. A high temperature has to be reached for a certain period of time in the chamber to complete this process. In principle, the higher the steam temperature, the less sterilization time is required. Experiments were carried out to assess temperature change at different locations of a fitment surface during the sterilization period with different steam pressure. The maximum pressure, temperature and time, which could be withstood by the fitment of the present invention and by a prior art fitment, were determined from these experiments. To make a comparison, fitments with both types of design were tested under the same test conditions.

Figure 15:
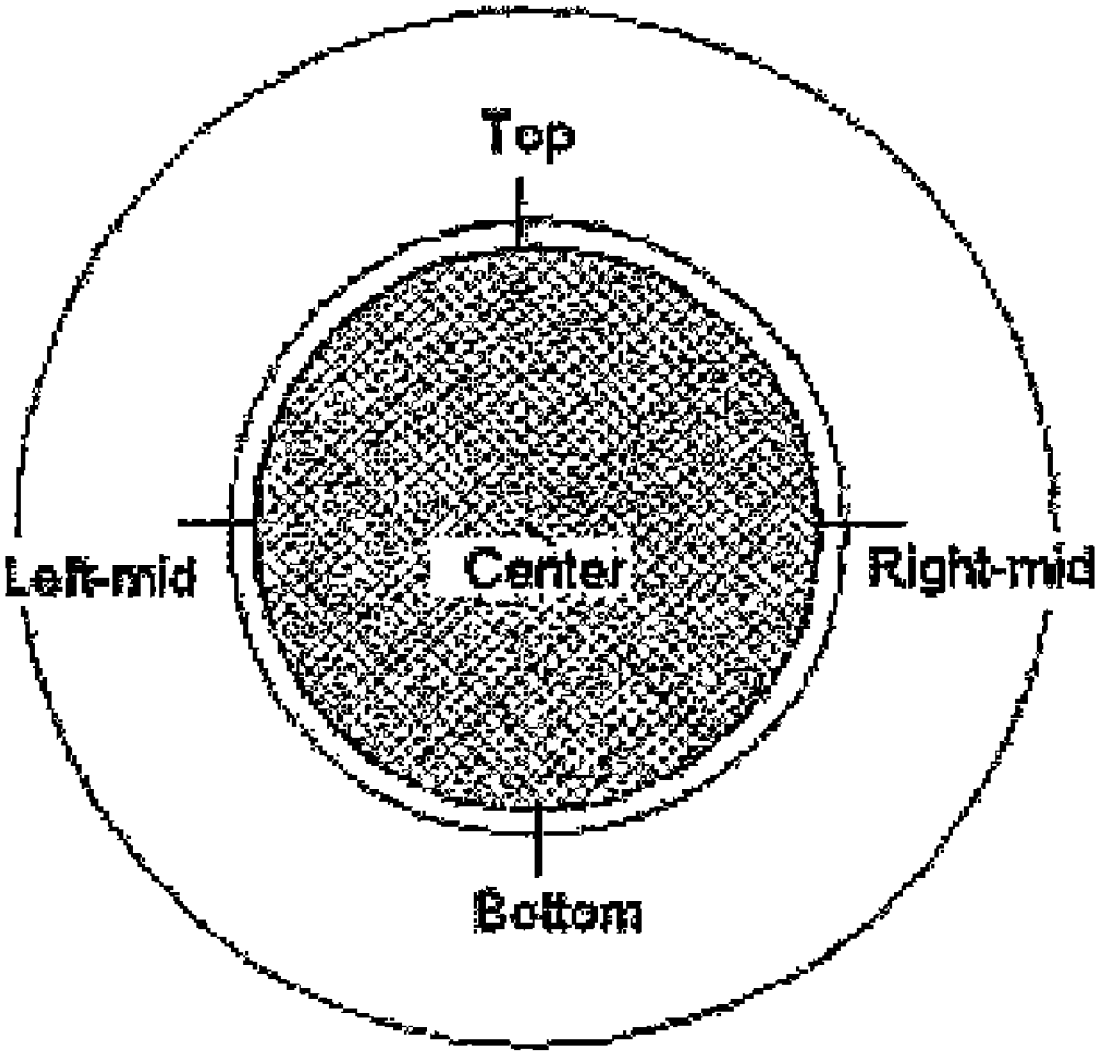
FIG. 15 shows placement of thermocouples on a surface of a fitment for a sterilization temperature test.

To conduct the experiments, a data acquisition system with scan rate 10 times/second was used. The temperatures on the fitment surface were measured by means of a thermo-element of K type. Thermocouples were placed at the edge and center of the plug. Four sensors were placed at top, right middle, bottom and left middle along the edge of the plug. One sensor was placed at center of the surface. The detailed measurement point on the fitment is shown in FIG. 15. For the fitment with an O-ring design, sensors were placed as close to the O-ring as possible.

A StarAsept 1307 filler manufactured by DuPont Liquid packaging systems, Liqui-Box in Worthington, Ohio US, was used for these tests. Before each test, the machine was set to automatic production mode. After the fitment was in place and the cycle started, the temperature was recorded through the cycle. To confirm the test results, several tests at the same test condition were repeated. Supply steam pressures at 30, 40, 50 and 60 PSI were used for these test.

Temperatures in the sterilized chamber and at the fitment surface were recorded for each test condition. It was found that it took 8 to 10 seconds for fitment with O-ring to reach the set temperate across the fitment top surface. Slightly less time, 6-8 seconds, was required for the integrated fitment. It was also observed that the prior art plug with an O-ring design deformed after 30 seconds of exposure to high-pressure steam. From a visual exam, it was found that the plug top surface sunk in and the crack between the plug and spout enlarged. With the integrated fitment of the present invention, no deformation can be seen under the same test condition. To investigate the effect of steam pressure, temperature and time on the deformation of the plug, tests were conducted for both types of the fitment with different pressure and expose time period.

Prior Art Fitment with O-Ring

At a steam pressure of 60 PSI, deformation of the plug surface was seen 10 seconds after the cycle start, after 20 seconds increased deformation and melting damage at the rim was observed. 60 seconds sterilization results in serious damage (deformation) of the plug.

At a steam pressure of 50 PSI, slight deformation of the plug surface was seen 20 seconds after the cycle start. After 30 seconds, increased deformation and melting damage at the rim was observed.

At a steam pressure of 40 PSI, only slight deformation of the plug was seen after 30 seconds. With 30 PSI setting, no obvious deformation can be seen after 30 seconds. Slight deformation was observed after 60 seconds exposed to the steam.

New Integrated Fitment

With a steam pressure of 60 PSI, no deformation on the plug was seen after 60 seconds of sterilization, but melting damage at rim of the spout was observed.

With 50, 40 and 30 PSI steam pressure, no damage or deformation was found on the fitment surface after a 60 seconds test.

To quantify the deformation, the plug height and diameter (at the top) changes after each test were measured and the results are listed in Table 1. Since a deformed plug surface is not flat, the lowest point at the surface was used as a measuring point for height.

These results indicate that with the integrated fitment of the present invention, relative high steam temperature and long sterilization time can be used without damage to the fitment.

TABLE 1

| Diameter and height change of the plug after test | | | | |
|---|---|---|---|---|
| Steam sterilization | Integrated fitment | | O-ring fitment | |
| condition | Δϕ* | ΔH** | Δϕ | ΔH |
| 60 PSI for 60 seconds | 0.06 | 0.18 | 1.39 | 4.82 |
| 60 PSI for 20 seconds | 0.02 | 0.0 | 0.58 | 0.91 |
| 50 PSI for 60 seconds | 0.04 | 0.0 | 1.27 | 2.58 |
| 50 PSI for 20 seconds | 0.0 | 0.0 | 0.42 | 0.36 |
| 40 PSI for 60 seconds | 0.0 | 0.0 | 1.0 | 2.40 |
| 40 PSI for 30 seconds | 0.0 | 0.0 | 0.75 | 1.60 |

TABLE 1-continued

| Diameter and height change of the plug after test | | | | |
|---|---|---|---|---|
| Steam sterilization | Integrated fitment | | O-ring fitment | |
| condition | Δϕ* | ΔH** | Δϕ | ΔH |
| 30 PSI for 60 seconds | 0.0 | 0.0 | 0.73 | 1.43 |
| 30 PSI for 30 seconds | 0.0 | 0.0 | 0.45 | 0.56 |

*Δϕ is the diameter difference of the plug top surface before and after test.
**ΔH is the height difference of the plug top surface before and after test

We claim:

1. A fitment, for use on a flexible container, said fitment comprising:

(A) a spout member having a first end and a second end and defining a passageway therebetween, wherein said first end has a planar opening surface and an inner protrusion extending thereof, wherein said second end has a flange for attachment of said spout member to a flexible container; and (B) a plug member having a body portion having a leading end defining an outer protrusion thereof, said body portion sized to be received within said passageway of said spout member and a flange for attaching said plug member to said flexible container;

wherein said plug member is movable between:

(i) a first position in which said leading end of said plug member lies flush with said first end of said spout member whereby a first seal is formed between the outer protrusion of the leading end of said plug member and the inner protrusion of said first end of said spout member, and (ii) a second position in which said leading end of said plug member extends beyond said first end of said spout member whereby a second seal is formed between the outer protrusion of said plug member and the planar surface of said spout member; and wherein said plug member and said spout member are formed of the same material.

2. A flexible container, comprising:

(A) at least a pair of opposed flexible walls sealingly attached to each other and forming a container therebetween; and (B) fitment of claim 1 attached thereto;

wherein said spout member is attached to the inner surface of a first flexible wall of said container and said plug member has its leading end extending beyond said first end of the spout member and in sealing engagement therewith.

* * * * *